United States Patent [19]

Johnson

[11] 4,222,719

[45] Sep. 16, 1980

[54] REVERSIBLE UNIDIRECTIONAL FLUID FLOW PUMP

[75] Inventor: Sigvold O. Johnson, Bloomington, Minn.

[73] Assignee: Thermo King Corporation, Minneapolis, Minn.

[21] Appl. No.: 418

[22] Filed: Jan. 2, 1979

[51] Int. Cl.[2] ..... F04C 15/02; F03C 3/00

[52] U.S. Cl. ..... 418/32; 418/171

[58] Field of Search ..... 418/32, 171; 417/315

[56] References Cited

U.S. PATENT DOCUMENTS

| | | | |
|---|---|---|---|
| 2,151,482 | 3/1939 | Neeson | 418/32 |
| 2,373,368 | 4/1945 | Witchger | 418/166 |
| 2,458,678 | 1/1949 | Bunte | 418/32 |
| 3,118,387 | 1/1964 | Aldrich | 418/32 |
| 3,208,392 | 9/1965 | Garrison et al. | 418/32 |
| 3,418,939 | 12/1968 | Kopp | 418/32 |
| 4,171,192 | 10/1979 | Taylor et al. | 418/32 |

FOREIGN PATENT DOCUMENTS

| | | | |
|---|---|---|---|
| 2055883 | 3/1972 | Fed. Rep. of Germany | 418/32 |
| 388767 | 3/1933 | United Kingdom | 418/32 |
| 584455 | 1/1947 | United Kingdom | 418/32 |

*Primary Examiner*—John J. Vrablik
*Assistant Examiner*—Rae Cronmiller
*Attorney, Agent, or Firm*—E. F. Possessky

[57] ABSTRACT

A reversible gerotor pump having unidirectional fluid flow therefrom dictated by a movable eccentric ring member 30 for positioning the rotor 46 of the pump gear-set 44 in either one of two axially eccentric positions depending upon the direction of rotation of the drive shaft 20 to the pump. Movement of the eccentric ring member from one such position to the other position upon a reversal of direction of the drive shaft is caused by check valve means 70 associated with the pump inlet 68 so that, if reverse rotation of the drive shaft momentarily causes reverse flow of the pumped fluid (e.g., causes the fluid to exit through the inlet) the check valve closes and establishes a hydraulic lock between the gear-set and forces the eccentric ring member to move from the one position to the other eccentric position whereupon the fluid is once again caused to be discharged through the normal pump outlet 64 and enter through the inlet. Under these conditions, the check valve opens to permit the pumped fluid to continue to enter the pump.

5 Claims, 3 Drawing Figures

REVERSIBLE UNIDIRECTIONAL FLUID FLOW PUMP

BACKGROUND OF THE INVENTION

1. Field of the Invention

This invention relates to a reversible unidirectional fluid flow pump and more particularly to such a pump commonly referred to as a gerotor pump and having means for ensuring continued unidirectional pumping upon reversal of the pump drive shaft.

2. Description of the Prior Art

Gear pumps such as the reversible pump described in U.S. Pat. No. 3,273,501 are commonly used to deliver lubricant to refrigerant compressors in a refrigeration system. As explained in U.S. Pat. No. 3,574,489, orbital gear-sets providing rolling contact between an outer internally toothed gear which has one more tooth than an inner externally-toothed gear in which gears mesh with their axes eccentric to one another are commercially available under the generic designation "gerotors". Pumps employing such gear sets for positive displacement of fluid caused by the rolling contact between the meshing and gear teeth are referred to as gerotor pumps.

In such gerotor pumps, the pump inlets and outlets are generally defined in face plates on opposing planar sides of the mating orbital gears, with the inlet generally diametrically opposed from the outlet. Thus, with the gears rotating in one direction, the pump inlet is adjacent the area where the gears are separating and the outlet is adjacent the area where the gears are converging. By reversing the direction of rotation of the gears, the pump outlet becomes the inlet and the pump inlet becomes the outlet.

However, in instances where reversibility of the direction of rotation of the pump is desired yet it is also necessary that the pump inlet and outlet do not reverse, as a lubricating system, the pump rotor (i.e., the outer, internally-toothed gear) has been disposed in an opening of a rotatable eccentric collar or ring member within the pump which can be rotated through a 180° arc to change the orientation of the eccentric axes between the rotor and the internal gear such that, in either direction of rotation, the eccentric collar is disposed in either of its two extreme positions so that the pump has a common inlet and outlet regardless of the direction of rotation of the pump shaft. The movement of the eccentric collar member through the 180° arc has heretofore been dependent upon internal friction within the pump such as friction between the drive shaft and the rotatable face plate positively engaging the eccentric collar, such as is shown in U.S. Pat. No. 3,165,066, or between the outer circular surface of the rotor and the internal cylindrical surface of the eccentric member as disclosed in previously-mentioned U.S. Pat. No. 3,273,501. An indexing pin limits the movement of the eccentric member of 180°. Thus, continuous rotation of the rotor as driven by the internal gear and the drive shaft causes continuous friction to maintain the collar member in the extreme eccentric position. However, in either instance, this continuous friction also causes wear between the parts such that in the first instance, the frictionally engaging parts tend to wear out quite readily and in the second instance, over a period of time, the friction between the eccentric member and the stationary face plate covering the rotor will be greater than the friction between the eccentric member and the rotor, resulting in the eccentric member not always being responsive to a reversal in the direction of rotation of the rotor to change its orientation, resulting in the pump not circulating the lubrication and thus causing damage to the machinery being lubricated.

SUMMARY OF THE INVENTION

The present invention is an improvement to the gerotor pumps above described and provides a check valve in the fluid inlet to the pump that, upon reversal of the direction of rotation of the pump, will close to prevent the pumped fluid from being discharged through the pump inlet even if the eccentric ring has not been rotated to the other eccentric position necessary to maintain fluid discharge through the pump outlet. Under such conditions, with the check valve closed, a hydraulic lock is established between the pump gear set and the eccentric ring that forces the ring to rotate in the direction of rotation of the drive shaft and gears, to the other indexed eccentric position to re-establish and maintain the flow through the normal pump outlet. Once the eccentric ring has assumed such position, the fluid is again discharged through the outlet and the check valve is opened by the fluid once again entering through the inlet.

DESCRIPTION OF THE PREFERRED EMBODIMENT

Figure 1:
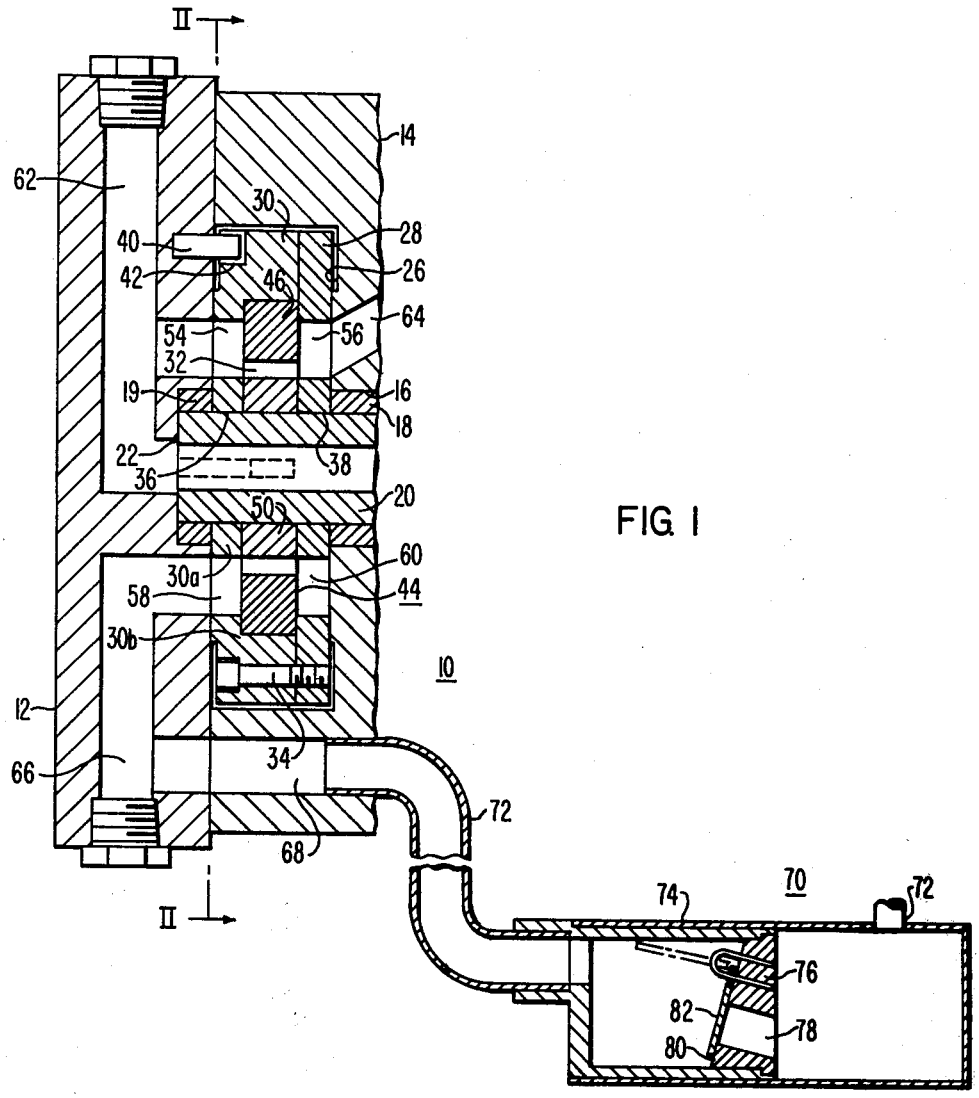
FIG. 1 is an axial cross-sectional view of a typical geroter pump with a check valve in the fluid inlet line to the pump.

Insofar as the instant invention may require a detailed explanation of the structure and operation of a typical reversible unidirectional fluid flow gerotor pump, copending commonly owed application Ser. No. 878,552, filed Feb. 16, 1978 and entitled "Reversible Gerotor Pump" is herein incorporated by reference for such descriptive detail. However, referring to FIG. 1, a cross-sectional view of a portion of such a pump 10 is shown and is seen to include a pump housing comprising a cover member 12 and a base member 14. The base member 14 has an axial opening 16 therethrough supporting a bushing 18 for receipt of a hollow drive shaft 20 from a reversible power source (not shown). The innermost terminal end 22 of the drive shaft 20 is also supported in a bushing 19 disposed in axial alignment within the cover member 12. The base member 14 defines a coaxial cup-shaped cavity 26 for receipt therein of a lower plate 28 and an opposing member 30 comprising, as an integral piece, a top plate **30*a* and eccentric ring 30*b*, defining therebetween an internal pump chamber 32. Member 30 and plate 28 are secured together as by a plurality of bolts 34 and have coaxial openings 36, 38 respectively for passage of the drive shaft 20. Member 30 and plate 28 are also movable or rotatable within the cavity 26 through an arc of substantially 180° as indexed by a stationary pin 40** in the cover member 12 projecting into a facing arcuate groove 42 in member 30. The pin abutts the generally diametrically opposed shoulders 42*a* and 42*b* defined by the groove 42.

A geroter gear-set 44 is enclosed in the pump chamber 32 and comprises an external rotor 46 having an outer circular periphery dimensioned to generally closely fit within the circular, offcenter or eccentric opening in member 30 and having internal teeth 48, and an internal gear 50 keyed to the drive shaft 20 and having external teeth 52 (with at least one less tooth than the rotor 46) meshing with the internal teeth 48 of the rotor 46. The top plate 30*a* and bottom plate 20 have opposed facing arcuate or kidney-shaped openings 54, 56 respectively and 58, 60 respectively in alignment with the path of the meshing gear teeth. As will be explained later, openings 54, 56 comprise fluid outlet openings from the pump chamber 32 and openings 58, 60 comprise fluid inlet openings to the chamber 32.

It is seen that openings 54, 56 are in fluid flow communication with pump outlet passages 62, 64 in the cover member with passage 64 in turn being plugged at the outlet in the upper cover 12 and being in flow communication with the hollow shaft 20 to deliver lubricant through the shaft as is known. Pump inlet openings 58 and 60 are in fluid flow communication with fluid inlet passages 66, 68 in the cover member to deliver the lubricant fluid to the pump chamber 32.

Still referring to FIG. 1, it is seen that a check valve 70 is serially connected in the inlet line 72 to the inlet passage 78 of the pump 10. The check valve 70 comprises a housing 74 enclosing a valve seat 76 defining an inlet opening 78 and having a slanted surface 80 on the downstream face thereof. A closure plate 82 is hingedly attached to the slanted face above the opening 78 and swingable under the force of the incoming oil to a non-blocking position. However, under zero fluid flow or reverse fluid through the inlet line 72, gravity will cause the closure plate 82 to swing into a blocking position over the opening 78 preventing any reverse flow therethrough, and, because of the slanted surface, the gravitational force will maintain a sealing relationship therebetween until the incoming flow is reestablished.

Figure 2:
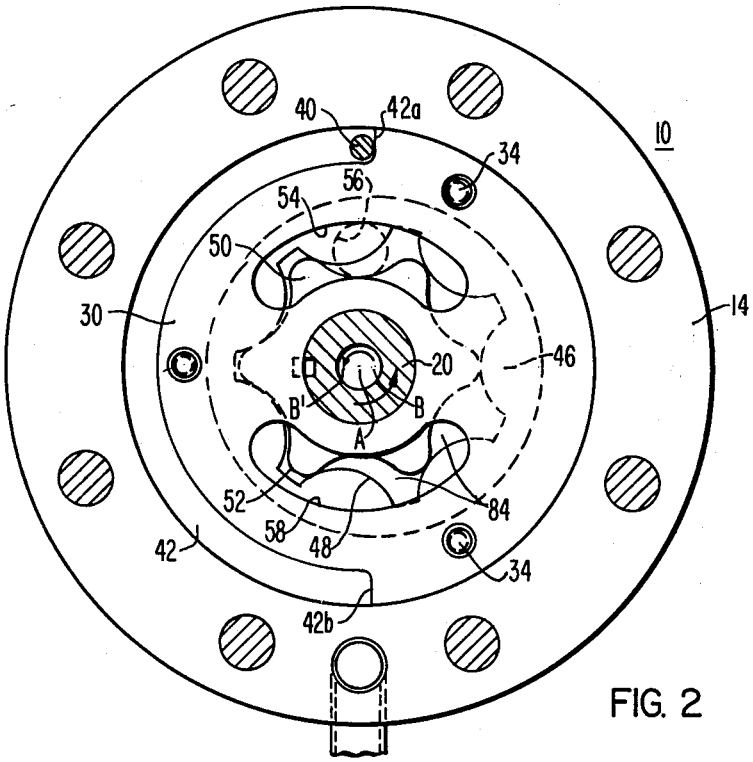
FIG. 2 is a top plan view of the pump generally along line II—II of FIG. 1 showing the orientation of the gear-set and eccentric ring during clockwise rotation of the pump shaft.
Figure 3:
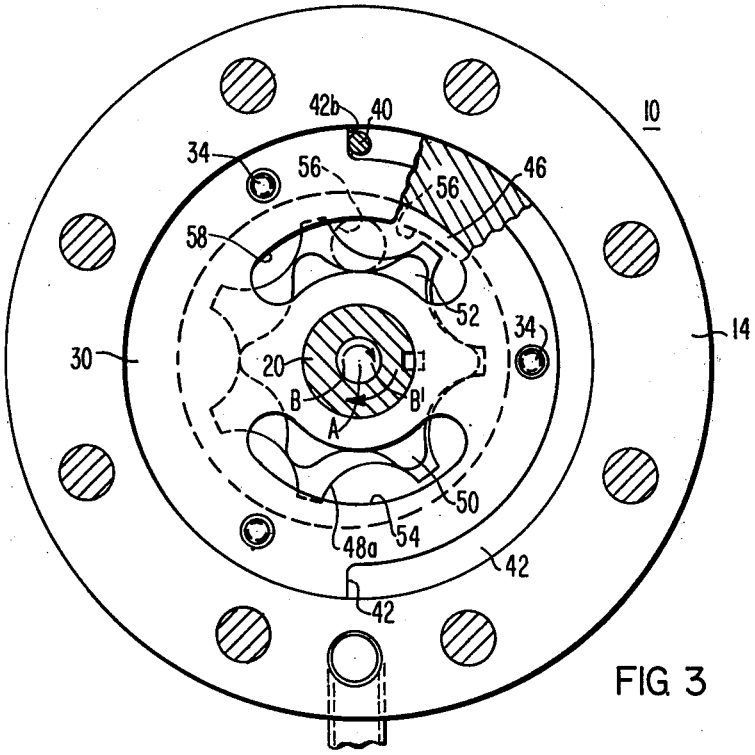
FIG. 3 is a view similar to FIG. 2 showing the orientation of the gear-set and eccentric ring providing unidirectional flow during reverse or counterclockwise rotation of the shaft.

Referring now to FIGS. 2 and 3, the relative positions of the gear-set 44 and eccentric member 30 is shown for maintaining unidirectional flow in either direction of rotation of the shaft 20. Thus, in FIG. 2, counterclockwise rotation of the shaft 20 is assumed (i.e., rotation in the direction of the arrow). As therein seen, the mating teeth of the gear-set 44 in the upper half of the pump are converging together indicating that the upper kidney-shaped opening 54 is a discharge opening whereas the teeth in the lower half of the pump are diverging or separating indicating that the lower kidney-shaped opening 58 is the inlet opening. Upon reversal of the shaft rotation, the eccentric member 30 must be moved or rotated 180° to place the gear-set 44 in the position shown in FIG. 3 wherein under reverse or clockwise rotation, the teeth of the gear-set 44 in the upper half are again converging to a meshing position and again the upper kidney-shaped opening 58 is a outlet, and the teeth in the lower half are separating to accept the oil in the space therebetween through the inlet opening 54. It will be noted however, that by reversing the rotation of the shaft 20, in either FIG. 2 or FIG. 3 without likewise changing the position of the eccentric member 30 through its 180° arcuate movement as controlled by pin 40 and groove 42, the outlet would become the pump inlet and the pump inlet 58 would become the pump outlet.

Thus, to illustrate the operation of the present invention, it is assumed that the direction of rotation of the pump shaft 20 as shown in FIG. 2 is reversed to the direction shown in FIG. 3 without the eccentric member 30 being moved from the position shown in FIG. 2. Under these circumstances, as explained above, the fluid would be discharged through the inlet 58 causing reverse fluid flow through the check valve 70. Such flow would cause the check valve to close whereupon no more fluid could be pumped from the opening 58. However, in that the fluid is non-compressible and the pump is a positive displacement pump, continued rotation of the shaft 20 requires that the space 84 between the converging teeth and which is filled with the fluid remains constant. This establishes a hydraulic lock between the gears 46 and 50 and requires outer gear or rotor 46 to be rotated in unison with inner gear 50 (as opposed to the normal ratio established by the difference in the gear teeth effective diameter). Thus, for the two gears 46, 50 to rotate together in unison, the outer gear 50 which has a center of rotation at B as dictated by the center of the eccentric 30 must be rotated with inner gear 50 so that the center of rotation thereof is at B′ as shown in FIG. 2. During this arcuate travel of the center of rotation of the outer gear, the space 84 will be maintained constant. To permit the rotation of outer gear 46 through this arcuate path, the center of the eccentric must also be rotated through this path which requires the eccentric member 30 to move from the position shown in FIG. 3 to the position shown in FIG. 3. Once the eccentric member 30 and the gear-set have rotated a distance sufficient to align the outlet opening 54 with the hydraulic locked fluid-filled space 84 between the gear-set, the fluid is discharged. However, this occurs when the eccentric member 30 has been rotated to its other eccentric position as shown in FIG. 3. Thus, if the eccentric member 30 does not move through its 180° arcuate movement to the new eccentric position through friction whenever the shaft 20 changes its direction of rotation, the hydraulic lock established by the check valve 70 within the pump chamber positively moves the eccentric member to such position the reestablish the unidirectional flow through the pump outlets 54, 56.

What I claim is:

1. In combination:

a unidirectional flow liquid pump having a pump chamber with inlet and outlet openings and enclosing a reversible rotatable gear-set means for positively displacing liquid from between converging meshing teeth of said gear-set means and wherein one gear of said gear-set means is rotated on an axis eccentric from the other gear of said gear-set means, and a movable member annular said gear-set means and reversibly rotatable through an arc of approximately 180° for positioning the axis of said one gear relative to the axis of said other gear to maintain liquid discharge from said pump chamber through said outlet openings regardless of the direction of rotation of said gear-set; and check valve means serially connected in flow communication with said pump inlet, said valve having a movable plate member disposed adjacent a stationary valve seat defining a valve opening therein, said plate member movable to an open position relative to said valve opening permitting flow to said pump inlet and to a closed position on said valve seat covering said opening preventing liquid flow from said inlet through said valve so that fluid cannot be discharged from said pump inlet upon reversal of the direction of rotation of said gear-set, and upon reversal of the direction of rotation of said gear-set without said annular member rotating to a position to maintian the discharge through the pump outlet said valve means establishes a hydraulic lock between the gears of said gear-set which in turn, under continued rotation of said gear-set, moves said annular member to said position to reestablish the discharge from said pump chamber through said outlet.

2. Structure according to claim 1 wherein said check valve is maintained is an open position by said liquid flowing through said valve opening to said pump inlet and is normally biased to a closed position.

3. Structure according to claim 2 wherein said valve seat is inclined from a vertical position to slant downwardly in the direction of flow of liquid therethrough and said plate is hingedly attached to said seat above said opening whereby gravity normally biases said plate to a closed position covering said opening.

4. In combination:

a unidirectional flow liquid pump having a pump chamber with inlet and outlet openings and enclosing a reversible rotatable gear-set means for positively displacing liquid from between converging meshing teeth of said gear-set means and wherein one gear of said gear-set means is rotated on an axis eccentric from the other gear of said gear-set means, and a movable annular member encircling said gear-set means and reversibly rotatable through a 180° arc for positioning the axis of said one gear relative to the axis of said other gear to maintain liquid discharge from said pump chamber through said outlet openings regardless of the direction of rotation of said gear-set; and a check valve serially connected in flow communication with said inlet, said check valve normally biased to an open position by liquid flowing therethrough toward said pump inlet and to a closed position by liquid under pressure to flow therethrough in the opposite direction whereupon reversal of the direction of rotation of said gear-set without said annular member moving to maintain discharge through said outlet causes said valve means to close preventing fluid discharge from said inlet and establishing a hydraulic lock between the gears of said gear-set which in turn, under continued rotation of said gear-set, moves said annular member to said position to reestablish the discharge from said pump chamber through said outlet whereupon said valve again opens to permit liquid into said pump.

5. Structure according to claim 4 wherein said check valve includes a generally planar valve seat defining a valve opening therethrough and inclined from a vertical position to slant downwardly in the direction of normal flow of liquid therethrough and a movable plate member hingedly attached to said seat above said opening on the downstream face thereof and sized so as to cover said opening and prevent reverse flow therethrough, whereby normally flowing fluid maintains said valve open and reverse flowing fluid causes said valve to close.

* * * * *